US007735826B2

(12) United States Patent
Shibayama

(10) Patent No.: US 7,735,826 B2
(45) Date of Patent: Jun. 15, 2010

(54) SHEET CONVEYING DEVICE AND IMAGE FORMING APPARATUS PROVIDED WITH THE SAME

(75) Inventor: Kouhei Shibayama, Osaka (JP)

(73) Assignee: Kyocera Mita Corporation (JP)

( * ) Notice: Subject to any disclaimer, the term of this patent is extended or adjusted under 35 U.S.C. 154(b) by 334 days.

(21) Appl. No.: 11/509,225

(22) Filed: Aug. 24, 2006

(65) Prior Publication Data

US 2007/0045943 A1 Mar. 1, 2007

(30) Foreign Application Priority Data

Aug. 31, 2005 (JP) ..... 2005-250448

(51) Int. Cl.
*B65H 5/00* (2006.01)

(52) U.S. Cl. ..... 271/264

(58) Field of Classification Search ..... 271/264, 271/256, 242; 399/16, 21, 22
See application file for complete search history.

(56) References Cited

U.S. PATENT DOCUMENTS

| | | | | |
|---|---|---|---|---|
| 4,431,179 | A * | 2/1984 | Westover et al. | 271/274 |
| 4,630,815 | A * | 12/1986 | Petersen et al. | 271/273 |
| 5,168,290 | A * | 12/1992 | Tanaka et al. | 346/134 |
| 6,557,850 | B1 * | 5/2003 | Kallin et al. | 271/274 |
| 6,730,010 | B2 * | 5/2004 | Yamakawa et al. | 493/267 |
| 7,249,763 | B1 * | 7/2007 | Moore et al. | 271/273 |
| 2005/0186008 | A1 * | 8/2005 | Imai | 400/618 |

FOREIGN PATENT DOCUMENTS

| | | |
|---|---|---|
| CN | 09-002702 | 1/1997 |
| JP | 59-217545 | 12/1984 |
| JP | 64-39340 | 3/1989 |
| JP | 5-58500 | 3/1993 |
| JP | 2002-211790 | 7/2002 |
| JP | 2004-075259 | 3/2004 |
| JP | 2005-154129 | 6/2005 |

* cited by examiner

*Primary Examiner*—Patrick Mackey
*Assistant Examiner*—Michael C McCullough
(74) *Attorney, Agent, or Firm*—Gerald E. Hespos; Michael J. Porco

(57) ABSTRACT

In a sheet conveying device, a multi-function frame in which optional devices such as a stack bypass, an envelope supplying unit and the like are mountable is connected to on an upstream of a conveyance frame defining a bottom surface of a sheet conveyance passage. A registration guide is pivotably supported on a downstream end portion of the multi-function frame and selectively shiftable over a first position of defining an upper surface of the sheet conveyance passage and a second position of opening an upper portion of the sheet conveyance passage. As a result, a sheet jam processing in the vicinity of the registration roller can be easily conducted.

10 Claims, 7 Drawing Sheets

SHEET CONVEYING DEVICE AND IMAGE FORMING APPARATUS PROVIDED WITH THE SAME

BACKGROUND OF THE INVENTION

1. Field of the Invention

The present invention relates to a sheet conveying device for conveying a sheet to an image forming section, and an image forming apparatus provided with the same, such as a digital copying machine, laser printer and the like. Particularly, it relates to a sheet jam processing function at the time of sheet conveyance.

2. Description of the Related Art

A conventional image forming apparatus is provided with an image forming section at a center thereof. In the image forming section, a predetermined image is formed by respective steps of charging, exposing, developing, and transferring. In order to form a fine image by using the image forming section, it is necessary to control the timing at which a sheet is conveyed to the image forming section and to correct an oblique conveyance of the sheet. For this reason, the conventional image forming apparatus is provided with a sheet conveying device including a registration roller and peripheral members thereof as disclosed in Japanese Unexamined Patent Publication No. Hei. 5-58500.

FIG. 9 is a cross sectional view showing a periphery of the sheet conveying device provided in the conventional image forming apparatus. In FIG. 9, a photoconductive drum (not shown) is accommodated inside a drum unit 20. A transferring roller 16 is provided beneath the drum unit 20. The photoconductive drum and the transferring roller 16 are used to transfer a toner image onto a sheet conveyed by a pair of registration rollers 14. A pair of conveying rollers 13 for conveying the sheet conveyed from a sheet supplying cassette or a stuck bypass (not shown) to the pair of registration rollers 14 are provided on an upstream of the pair of registration rollers 14 in the sheet conveyance direction.

In a state that the registration rollers 14 are suspended, a leading end of the sheet conveyed through the pair of conveying rollers 13 and the sheet conveyance passage 22 comes into contact with a nip portion of the pair of registration rollers 14 and the oblique conveyance of the sheet is corrected. Thereafter, the pair of registration rollers 14 are driven to convey the sheet in synchronization with the timing of the image formation of the image forming section. A registration guide 23 is provided above the sheet conveyance passage 22 between the pair of registration rollers 14 and the pair of conveying rollers 13.

A detecting sensor 24 detects a presence of the sheet which passes through the sheet conveyance passage 22, and is provided in the vicinity of the registration guide 23 in such a manner that an emitting surface of the detecting sensor faces the sheet conveyance passage 22. The detecting sensor 24 detects a passing of the leading end of the sheet, and the detection is sent to a controlling section (not shown) of a main body of the image forming apparatus. A contact-making amount (slackness amount) of a sheet against the pair of registration rollers 14 is determined by controlling the time period from the passing of the leading end of the sheet to a stopping of the driving of the pair of conveying rollers 13 by the controlling section. Further, the detecting sensor 24 detects a non-standardized sheet by continuously detecting the sheet from the leading end to the tailing end to detect a size of the sheet. The sheet size is used when the controlling section determines a suspension time of the pair of registration rollers 14 and a suspension time of the image formation.

FIG. 10 is a perspective view showing an image forming apparatus in which a developing unit 5 positioned above the sheet conveyance passage 22 is taken off, and a sheet jam processing is conducted from above. FIG. 10 shows the state that the developing unit 5 is taken off, and a part of the main body including the drum unit 20, the registration guide 23, and the like is omitted. An upper portion of the sheet conveyance passage 22 is opened from a stuck bypass 11*b* to the pair of registration rollers 14 (see FIG. 9.) by taking the developing unit 5 off to conduct the sheet jam processing in the sheet conveyance passage 22.

In the foregoing conventional image forming apparatus, the registration guide 23 (see FIG. 9.) is so designed to be pivotable in upwardly and downwardly about a pivot positioned in the vicinity of the registration rollers 14. Thus, when the sheet jam processing is conducted, the registration guide 23 is rotated toward the side of the drum unit 20 to remove the sheet.

However, a user is required to stretch his/her arm into a narrow space in the vicinity of the pair of the registration rollers 14 to rotate the registration guide 23 to remove the jammed sheet. In addition to that, the space for the pivotal of the registration guide 23 is limited due to the drum unit 20 positioned above the pair of registration rollers 14. Accordingly, it has not been easy to conduct the sheet jam processing. Further, there is not any means for rotating the registration guide 23. Consequently, the operation is troublesome.

SUMMARY OF THE INVENTION

It is an object of the present invention to provide a sheet conveying device which can ensure an easy sheet jam processing in the vicinity of a registration roller, and an image forming apparatus provided with the same.

According to an aspect of the present invention, a sheet conveying device includes a registration roller for correcting an oblique conveyance of a sheet by making contact with the sheet, and conveying the sheet in accordance with the timing of an image formation; a conveying roller mounted on an upstream of the registration roller in a sheet conveyance direction for conveying the sheet from a sheet supplying device to the registration roller; and a guide member provided between the registration roller and the conveying roller. The guide member is pivotably supported, and its pivotal axis is in an upstream of a sheet conveyance passage between the registration roller and the conveying roller. The guide member is selectively shiftable over a first position of defining a part of the sheet conveyance passage and a second position of opening an upper portion of the sheet conveyance passage.

According to another aspect of the present invention, an image forming apparatus includes such a sheet conveying device and a unit detachably mounted above the guide member of the sheet conveying device.

With the above arrangement, the guide member is pivotably supported, and its pivotal axis is on the upstream of the sheet conveyance passage between the registration roller and the conveying roller, and the guide member is selectively shiftable over the first position and the second position. Accordingly, in comparison with the conventional configuration having the pivotal axis on a downstream of the sheet conveyance passage, the space for the pivotal of the guide member is so large that the pivotal operation of the guide member can be easily conducted. As a result, the jammed sheet can be easily removed since the sheet conveyance passage is widely exposed.

DETAILED DESCRIPTION OF THE PREFERRED EMBODIMENTS

Figure 1:
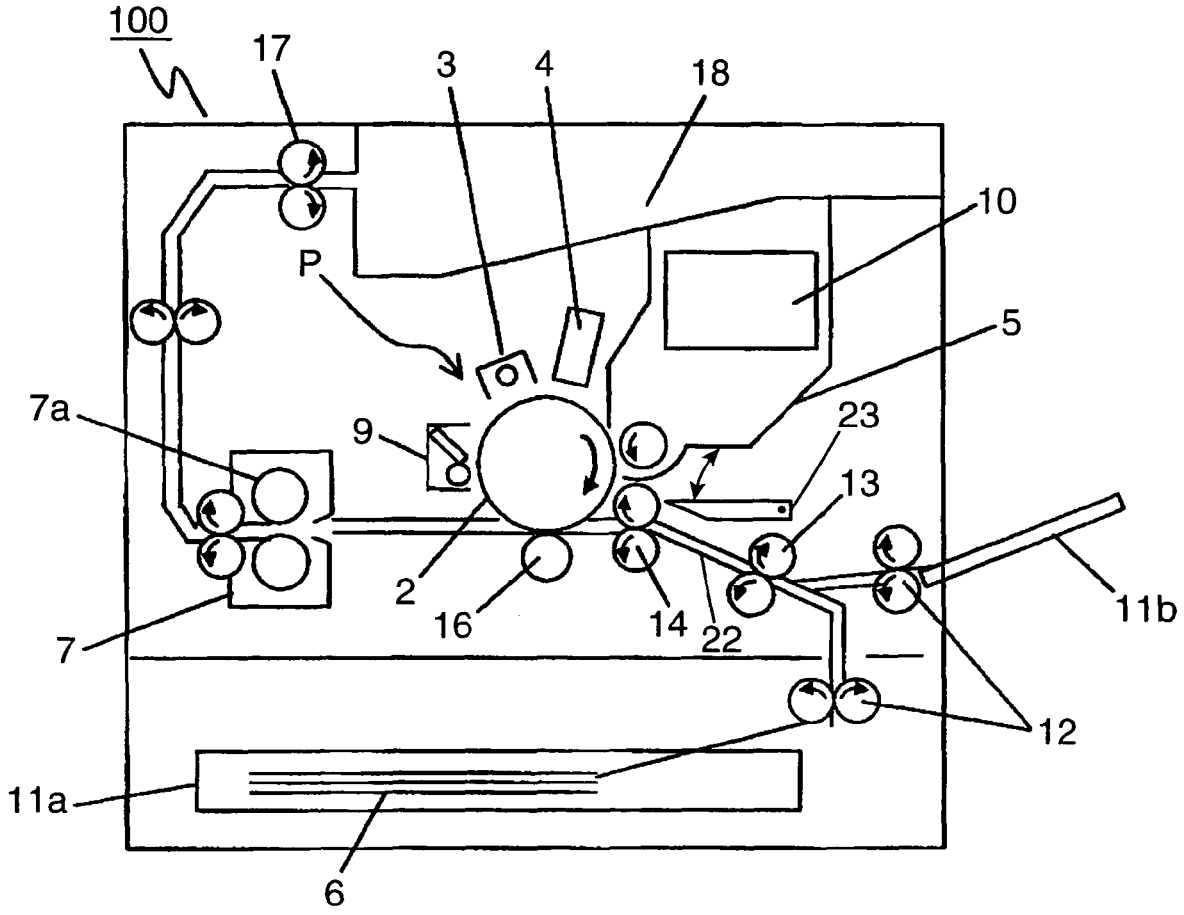
FIG. 1 is a schematic diagram showing a general configuration of an image informing apparatus provided with a sheet conveying device according to an embodiment of the present invention.
Figure 2:
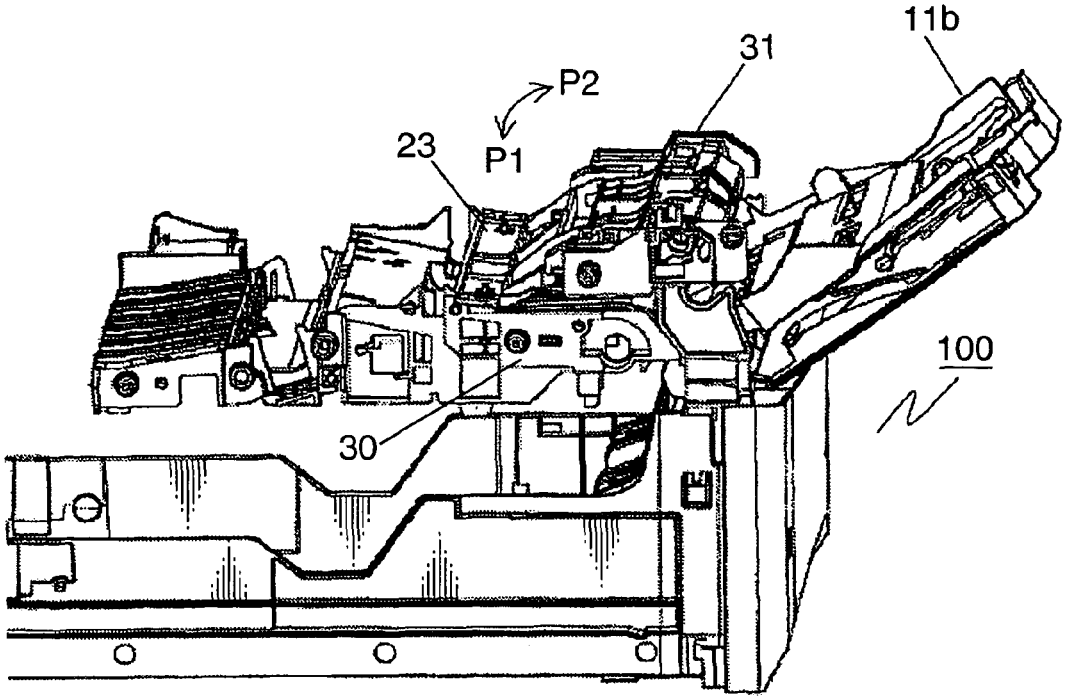
FIG. 2 is a partially perspective view of a periphery of the sheet conveying device, showing a state that a registration guide of the sheet conveying device provided in the image forming apparatus shown in FIG. 1 is in a first position.
Figure 3:
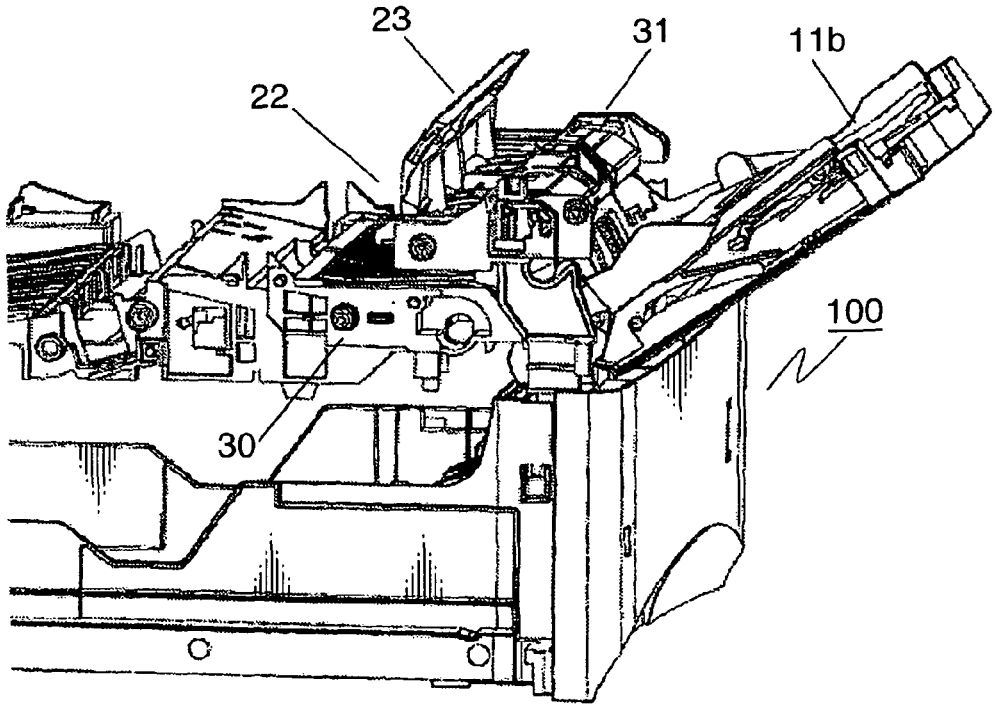
FIG. 3 is a partially perspective view of the periphery of the sheet conveying device, showing a state that the registration guide of the sheet conveying device provided in the image forming apparatus shown in FIG. 1 is in a second position.
Figure 9:
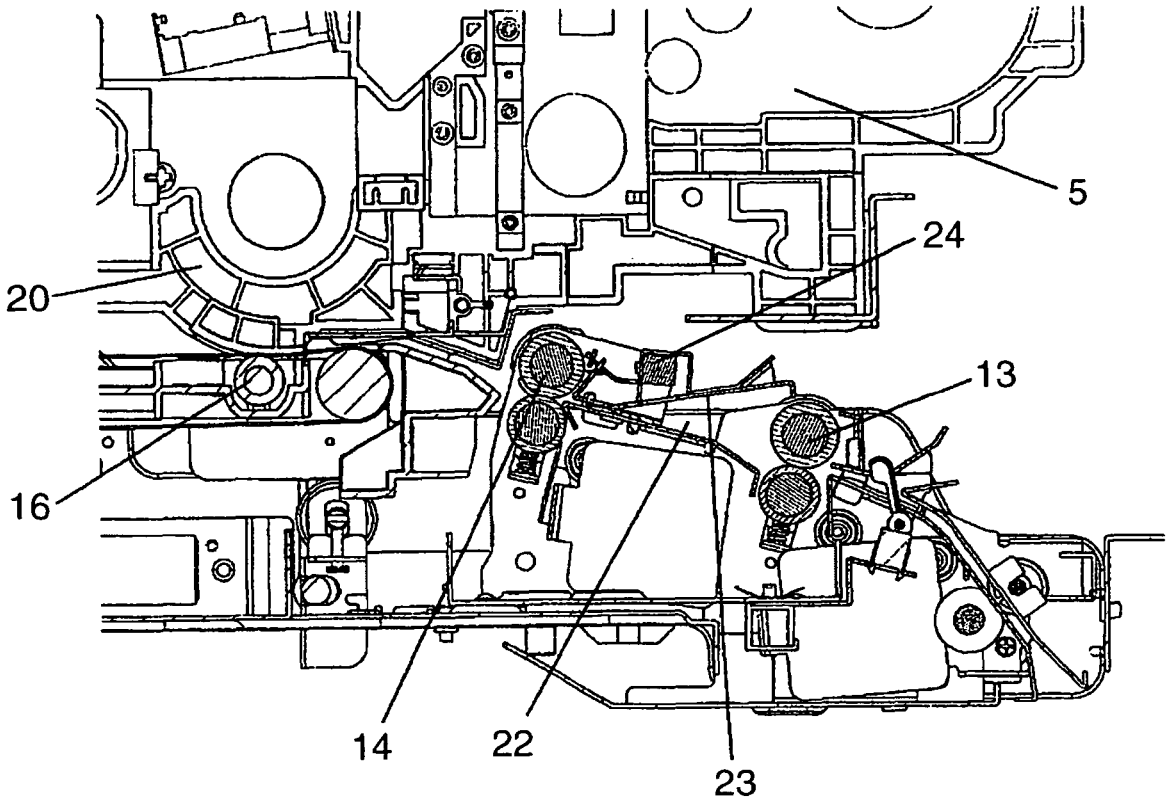
PRIOR ART FIG. 9
FIG. 9 is a cross sectional enlarged view showing a periphery of a pair of registration rollers in a conventional image forming apparatus.
Figure 10:
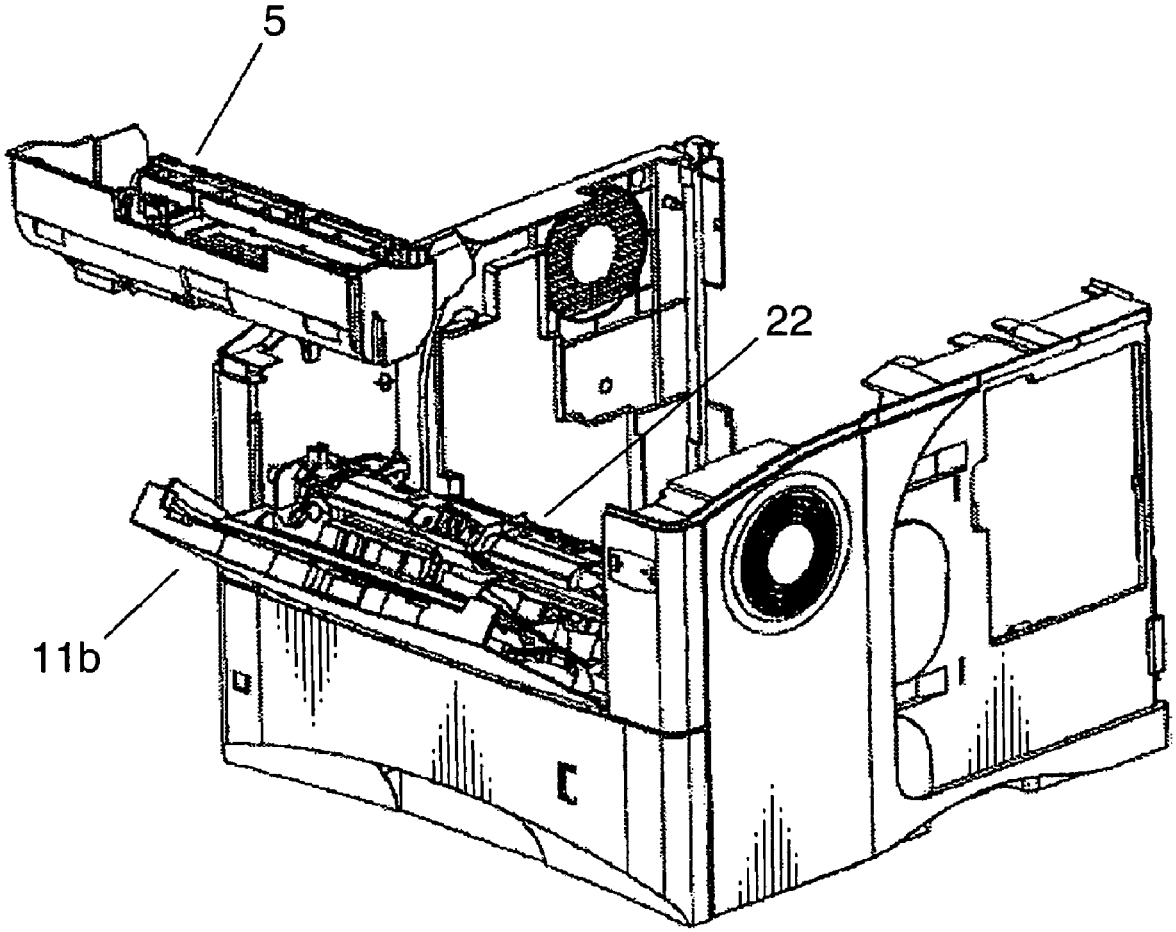
PRIOR ART FIG. 10
FIG. 10 is a perspective view showing a state that a developing unit is taken off from the conventional image forming apparatus.

Hereinafter, an embodiment of the present invention is described referring to the drawings. FIG. 1 is a schematic diagram showing a whole configuration of an image forming apparatus in which a sheet conveying device according to an embodiment of the present invention is mounted. FIGS. 2 and 3 are partial perspective views mainly showing a configuration of the sheet conveying device in the image forming apparatus shown in FIG. 1. It should be noted that a detailed description of common parts as in the prior art shown in FIGS. 9 and 10 are omitted by providing the same reference numbers.

An image forming apparatus 100 shown in FIG. 1 is provided with an image forming section P in which a predetermined image is formed by respective steps of charging, exposing, developing and transferring. In the image forming section P, a photoconductive drum 2 which bears a visible image (a toner image) thereon is provided. The toner image formed on the photoconductive drum 2 is transferred onto a sheet 6 (a recording medium) conveyed through a sheet conveyance passage 22 provided adjacently to the image forming section P. Further, after the transferred toner image is fixed onto the sheet 6 in a fixing section 7, the sheet 6 is discharged from a main body. As mentioned above, the image forming processing to the photoconductive drum 2 is conducted by rotating the photoconductive drum 2 in a clockwise direction in FIG. 1.

Next, the image forming section P is described in detail. A charger 3, an exposing unit 4, a developing unit 5, and a cleaning portion 9 are provided around and above the photoconductive drum 2 which is rotatably mounted. The charger 3 is adopted for charging the photoconductive drum 2. The exposing unit 4 is adopted for exposing image information on the photoconductive drum 2. The developing unit 5 is adopted for forming the toner image on the photoconductive drum 2. The cleaning portion 9 is adopted for removing developing agent particles (toner particles) remaining on the photoconductive drum 2.

First, the charger 3 charges a peripheral surface of the photoconductive drum 2 uniformly, then the exposing unit 4 emits a light beam to form a electrostatic latent image in accordance with an image signal on the photoconductive drum 2. A toner container 10 is installed in the developing unit 5. Toner particles in the toner container 10 is supplied to the photoconductive drum 2 by the developing unit 5 and electrostatically attached thereon so that a toner image is formed in accordance with the electrostatic latent image formed by the exposure from the exposing unit 4.

Sheets 6 are accommodated in a sheet supplying cassette 11*a* or stacked in a stack bypass 11*b* (a manually supplying tray) provided in a side of an upper pair of sheet supplying rollers 12. A sheet 6 to which a toner image is to be transferred is supplied from the sheet supplying cassette 11*a* and the like through the pair of sheet supplying rollers 12, a pair of conveying rollers 13, and a pair of registration rollers 14, to the image forming section P, and conveyed to a position where the photoconductive drum 2 is arranged.

At this time, in the state that the pair of registration rollers 14 are suspended, a leading end of the sheet conveyed through the pair of conveying rollers 13 and the sheet conveyance passage 22 comes into contact with a nip portion of the pair of registration rollers 14 and an oblique conveyance of the sheet is corrected. Thereafter, the pair of registration rollers 14 are driven to convey the sheet in synchronization with the timing of the image formation of the image forming section P. A registration guide 23 is an example of a guide member, and provided between the pair of registration rollers 14 and the pair of conveying rollers 13. A bottom surface of the registration guide 23 defines an upper surface of the sheet conveyance passage 22 between the pair of registration rollers 14 and the pair of conveying rollers 13.

Further, a detecting sensor (not shown) detects a presence of the sheet which passes through the sheet conveyance passage 22, and is provided in the vicinity of the registration guide 23 in such a manner that an emitting surface of the detecting sensor faces the sheet conveyance passage 22. The detecting sensor detects a passing of the leading end of the sheet, and the detection is sent to a controlling section (not shown) of the main body of the image forming apparatus. A contact-making amount (slackness amount) of a sheet against the pair of registration rollers 14 is determined by controlling the time period from the passing of the leading end of the sheet to a stopping of the driving of the pair of conveying rollers 13 by the controlling section. Further, a detecting sensor 24 continuously detects a non-standardized sheet from the leading end to the tailing end to detect a size of the sheet. The sheet size is used when the controlling section determines a suspension time of the pair of registration rollers 14 and a suspension time of the image formation.

As mentioned above, an image formation signal is turned ON in synchronization with the timing when the conveyance of a sheet 6 from the pair of registration rollers 14 is permitted, and an image is formed on the photoconductive drum 2. Underneath the photoconductive drum 2, the toner image formed on the photoconductive drum 2 is transferred onto the sheet 6 owing to an electric field generated by the transferring roller 16 applied with a predetermined transferring voltage.

The sheet 6 onto which the toner image has been transferred leaves from the photoconductive drum 2, and is conveyed to the fixing section 7. The photoconductive drum 2 from which the toner image has been transferred, toner particles remaining on the peripheral surface of the photoconductive drum are removed by the cleaning portion 9 for subsequent formation of a new electrostatic latent image. The sheet 6 conveyed from the image forming section P to the fixing section 7 is heated and pressed by a pair of fixing rollers 7*a* so that the toner image is fixed on the surface of the sheet 6, and the expected image is consequently formed. Thereafter, the sheet 6 bearing the image is discharged to a discharge tray 18 by a pair of discharging rollers 17.

Further, in the image forming apparatus 100 configured as mentioned above, as shown in FIGS. 2 and 3, a multi-function frame 31, which are mountable with optional devices such as the stack bypass 11*b*, an envelope supplying unit, is connected to an upstream of a conveyance frame 30 defining a bottom surface of the sheet conveyance passage 22. The multi-function frame 31 is an example of the frame member.

The registration guide 23 is supported in a downstream end portion of the multi-function frame 31 and pivotable in directions of P1 and P2 (see FIG. 2). FIG. 2 shows a state where the registration guide 23 is in a position of defining the upper surface of the conveyance passage 22 (hereinafter, referred to as first position). FIG. 3 shows a state where the registration guide 23 is in a position of opening an upper portion of the sheet conveyance passage 22 (hereinafter, referred to as second position). As mentioned above, the registration guide 23 is disposed in the sheet conveyance passage 22 between the pair of registration roller 14 and the pair of conveying roller 13, and pivotably supported at the pivot at an upstream of the sheet conveyance passage 22. The registration guide 23 is selectively shiftable over the first position of defining a part of the sheet conveyance passage 22 and the second position of opening the upper portion of the sheet conveyance passage 22.

Figure 4:
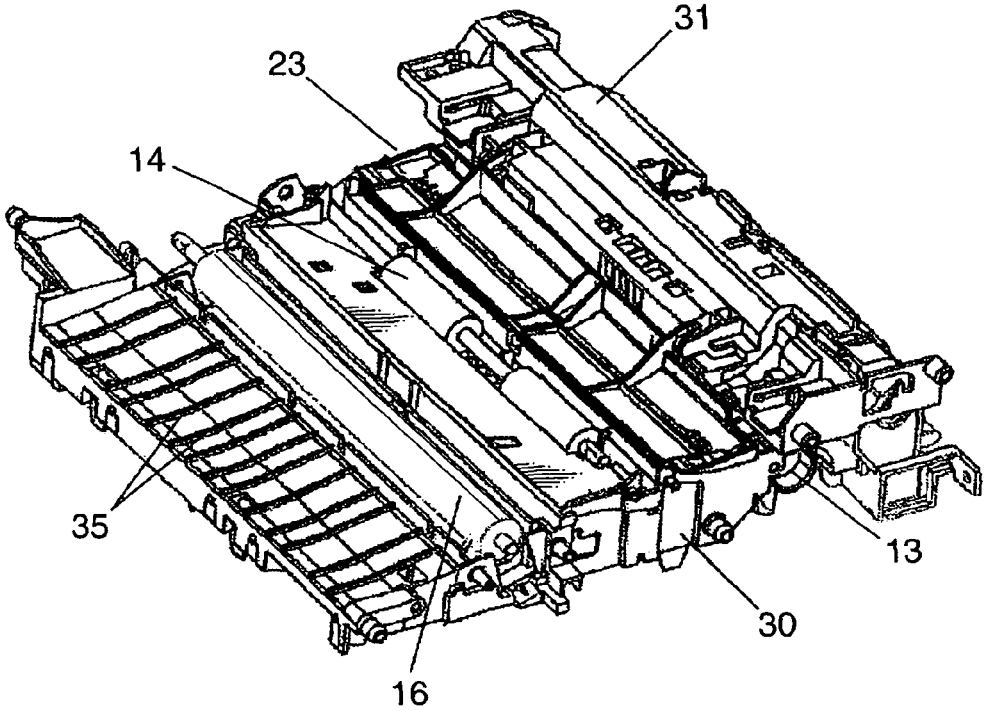
FIG. 4 is a perspective view showing a configuration of the sheet conveying device shown in FIGS. 2 and 3.

FIG. 4 is a perspective view showing a configuration of the sheet conveying device shown in FIGS. 2 and 3. As shown in FIG. 4, the pair of conveying rollers 13, the pair of registration rollers 14, and the pair of transferring rollers 16 are mounted on the conveyance frame 30 in this order in the sheet conveying direction from the upstream. On an upper surface of the conveyance frame 30 which defines the bottom surface of the sheet conveyance passage are integrally formed a plurality of ribs 35 in a direction parallel to the conveying direction to minimize the contact area to a sheet to reduce the friction and ensure smooth sheet conveyance. The registration guide 23 and the part of the conveyance frame 30 define the sheet conveyance passage 22 from the pair of conveying rollers 13 to the pair of registration rollers 14.

Figure 5:
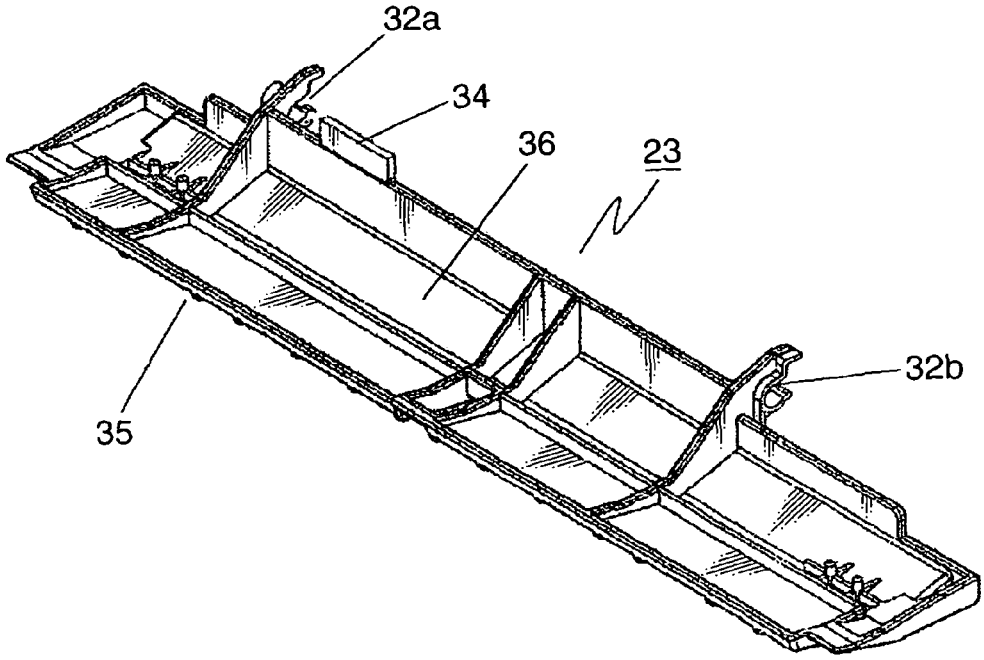
FIG. 5 is a perspective view showing a configuration of the registration guide shown in FIG. 4.

FIG. 5 is a perspective view showing the registration guide 23 shown in FIG. 4 viewed from above. The registration guide 23 includes two engaging portions 32*a* and 32*b*, a tab portion (operating portion) 34, a plurality of ribs 35, and a conveyance passage defining member 36. These are integrally formed into one body. The registration guide 23 is made of a resin and the like. However, the material is not limited to the resin, and the registration guide 23 may be partly or entirely made of a metal and the like.

An underside surface of the conveyance passage defining member 36 constitutes a part of the upper surface of the sheet conveyance passage 22 between the pair of registration rollers 14 and the pair of conveying rollers 13. The conveyance passage member 36 is formed with the engaging portions 32*a*, 32*b* at two positions on the upstream in the conveying direction. The engaging portions 32*a* and 32*b* are rotatably engaged on engagement projections 33*a* and 33*b* formed on the multi-function frame 31 (see FIG. 6). Further, in the vicinity of the engaging portion 32*a*, the tab portion 34 is provided in the state of projecting upward to enable a user to turn the registration guide 23. The tab portion 34 has a rectangular shape, and substantially perpendicularly intersects a principal plane of the conveyance passage defining member 36. The tab portion 34 is integral with the conveyance passage defining member 36.

The registration guide 23 is provided with a plurality of ribs 35 in the direction parallel to the sheet conveying direction to ensure smooth sheet conveyance on the inner surface of the registration guide 23 or the underside surface of the conveyance passage defining member 36 that constitutes the part of the upper surface of the sheet conveyance passage 22, similarly to the conveyance frame 30. In this embodiment, the tab portion 34 is provided at the single location in the vicinity of the engaging portion 32*a*. However, it may be appreciated to provide a tab portion 34 in the vicinity of the engaging portion 32*b*, or at a center of the registration guide 23, or at two locations of left and right sides of the registration guide 23. Further, the tab portion 34 may be formed into an appropriate shape to ensure an easier operability to a user.

Figure 6:
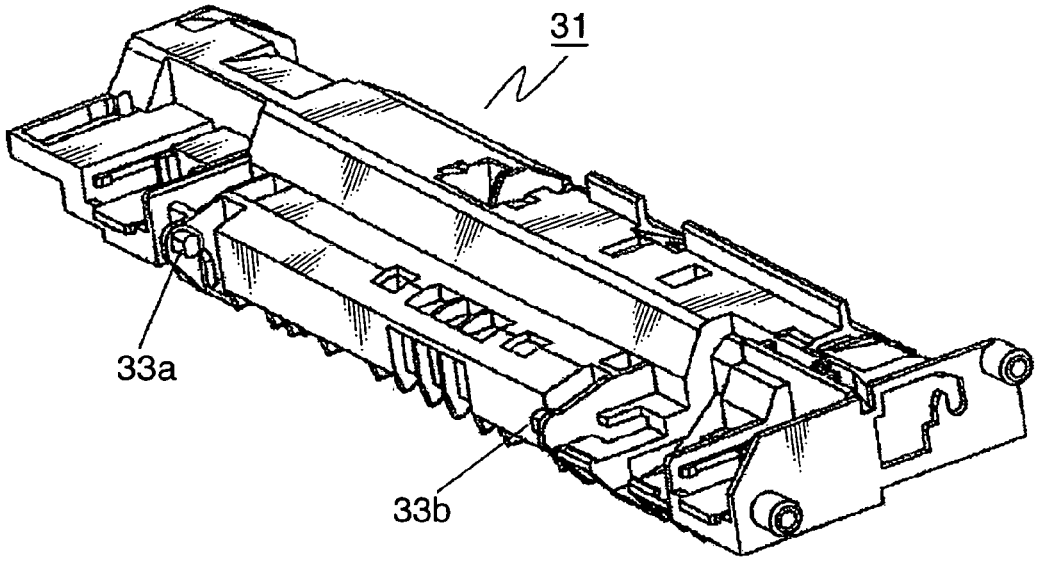
FIG. 6 is a perspective view showing a configuration of a multi-function frame on which the registration guide shown in FIG. 4 is mounted.

FIG. 6 is a perspective view of the multi-function frame 31 shown in FIG. 4. The multi-function frame 31 is provided with the engagement projections 33*a* and 33*b* to which the engaging portions 32*a* and 32*b* (see FIG. 5.) of the registration guide 23 are engaged, on a downstream end of the multi-function frame 31 in the conveying direction. The multi-function frame 31 is provided with screw holes, engagement members such as engagement claws (not shown), and the like for mounting the optional devices such as the stack bypass 11*b*, the envelope supplying unit on an upstream of the multi-function frame 31 in the conveying direction.

Figure 7:
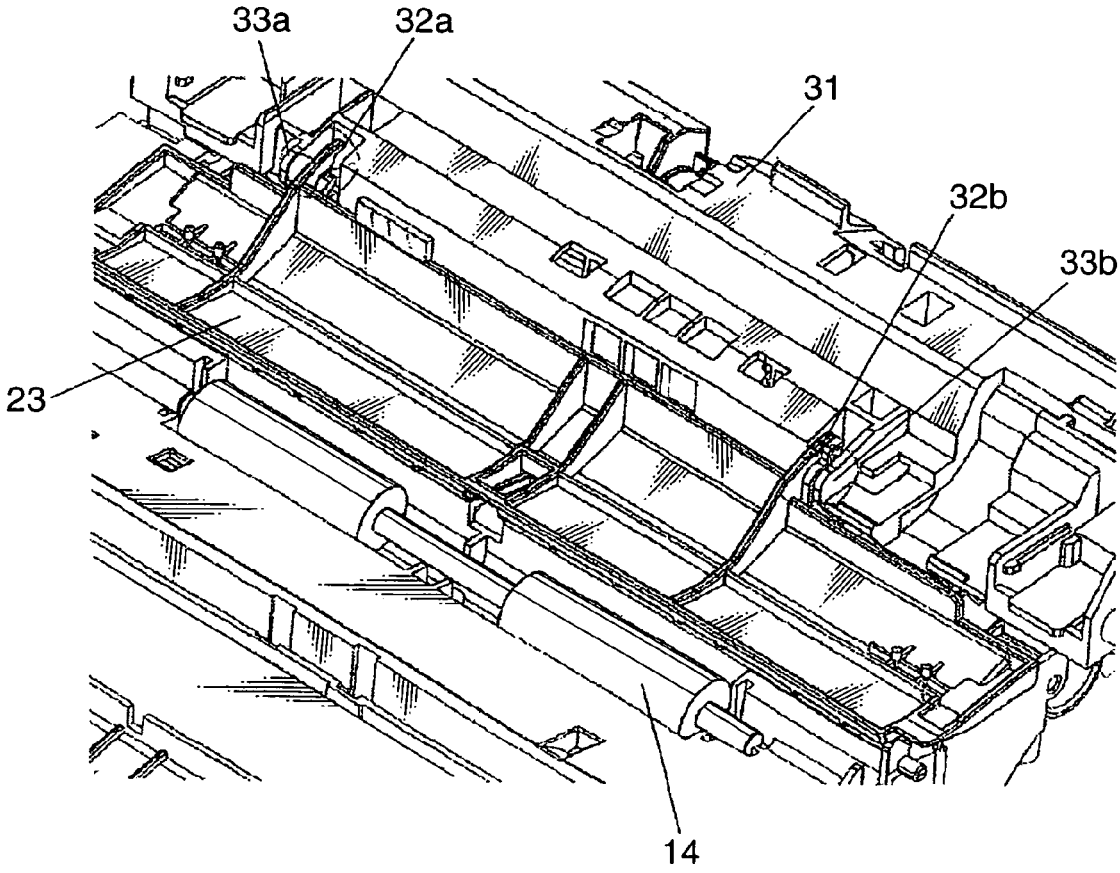
FIG. 7 is an enlarged view showing a state that the registration guide shown in FIG. 5 and the multi-function frame shown in FIG. 6 are engaged with each other.

FIG. 7 is an enlarged view showing a state where the registration guide 23 shown in FIG. 5 and the multi-function frame 31 shown in FIG. 6 are engaged with each other. As shown in FIG. 7, the engaging portions 32*a* and 32*b* are engaged with the engagement projections 33*a* and 33*b* so that the registration guide 23 is pivotally supported about the engagement projections 33*a* and 33*b*, and is selectively shiftable over the first position shown in FIG. 2 and the second position shown in FIG. 3.

Figure 8A:
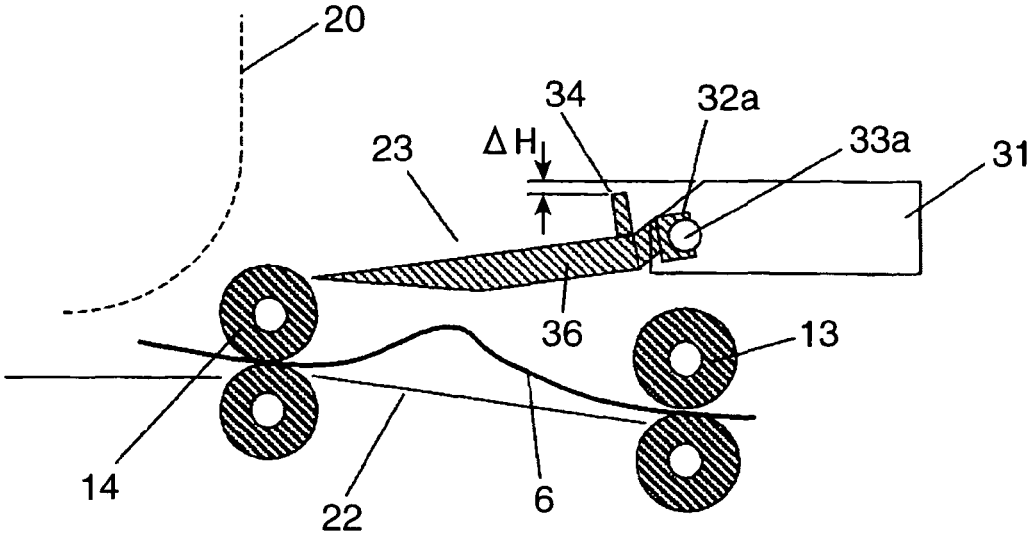
FIG. 8A is a side view showing a state that the registration guide shown in FIG. 5 is in the first position.
Figure 8B:
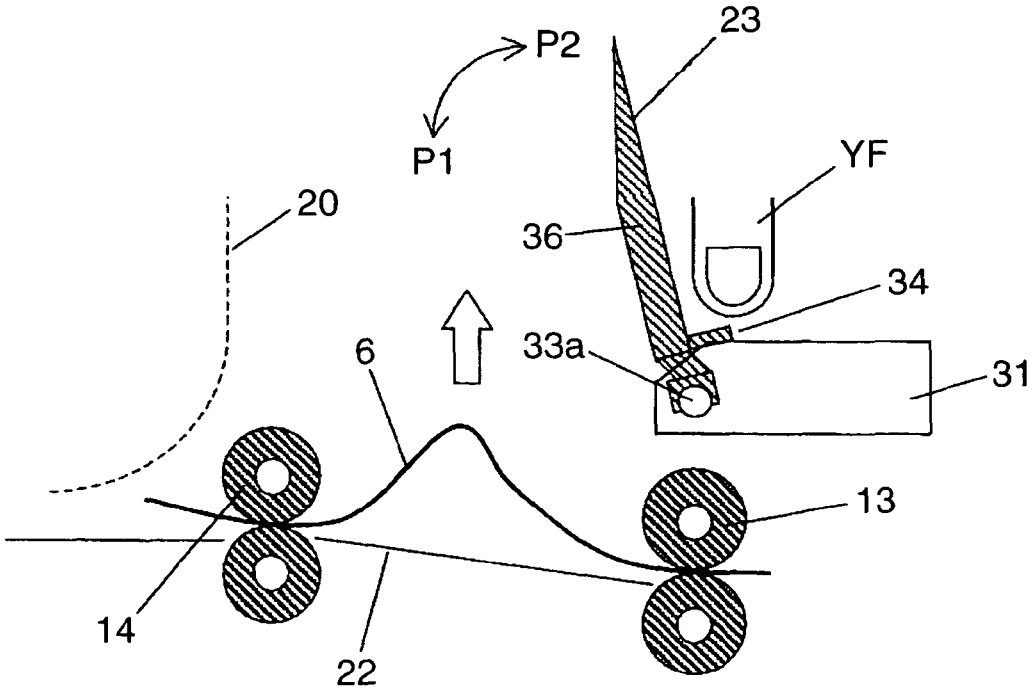
FIG. 8B is a side view showing a state that the registration guide shown in FIG. 5 is in the second position.

Next, a method of conducting a sheet jam processing by rotating the registration guide 23 is described in detail referring to FIGS. 8A and 8B. FIG. 8A is a side view showing the state where the registration guide 23 is in the first position. FIG. 8B is a side view showing the state where the registration guide 23 is in the second position. For the convenience of explanation, description of the conveying frame 30 is omitted.

Here, supposing that a sheet 6 is jammed between the pair of conveying rollers 13 and the pair of registration rollers 14, the developing unit 5 (see FIG. 1) mounted above the registration guide 23 is firstly taken off by a user. The registration guide 23 is in the state shown in FIG. 8A. In the state where the registration guide 23 is in the first position, the tab portion 34 is integrally formed with the conveyance passage defining member 36 in such a manner that the top of the tab portion 34 is below the upper surface of the multi-function frame 31 by a predetermined distance of ΔH.

Next, in the state shown in FIG. 8A, the user puts his/her hand in a space where the developing unit 5 has been taken off, and pushes the tab portion 34 with his/her finger YF to rotate the registration guide 23 to the direction of an arrow P2 as shown in FIG. 8B to shift the registration guide 23 into the second position. At this time, the tab portion 34 comes into contact with the upper surface of the multi-function frame 31. The jammed sheet 6 is pulled upwardly for removal. Then, the registration guide 23 is rotated in the direction of an arrow P1 to return the registration guide 23 to the first position as shown in FIG. 8A. Thereafter, the developing unit 5 is again mounted in, and the sheet jam processing is completed.

With this arrangement, in comparison with the conventional configuration where the pivotal axis is in the vicinity of the pair of registration rollers 14, the jammed sheet 6 can be more easily removed since the drum section 20 does not hinder the removing operation, and the pivotal space of the registration guide 23 is so large that the sheet conveyance passage 22 exposes more widely. Further, the tab portion 34 is provided on the registration guide 23 to thereby enable the registration guide 23 to be shifted to the second position only by pushing the tab portion 34. Accordingly, the provision of the above-described sheet conveying device makes it possible to provide an image forming apparatus which is easily operable, and simple, and can be produced at low costs.

Further, in FIG. 8B, it is preferable that the registration guide 23 automatically returns to the first position by its own weight or biasing force of a biasing member such as a spring, after releasing the pressing of the user's finger YF onto the tab portion 34. With this configuration, the registration guide 23 can be returned back to the first position without fail after the completion of the sheet jam processing. This can eliminate the likelihood of deforming and breaking the registration guide 23 or the developing unit 5 due to the remounting of the developing unit 5 while the registration guide 23 is in the second position.

Further, the present invention is not limited to the foregoing embodiment. Various modifications may be made without departing from the scope of the present invention. For example, in the foregoing embodiment, the registration roller 23 is supported by the multi-function frame 31 on which the optional devices are mounted. However, in the case of an image forming apparatus not including the multi-function frame 31, the registration guide 23 may be attached to the other member such as a conveying frame that is provided on an upstream of the registration guide in the conveying direction.

Further, in the foregoing embodiment, the detachable developing unit 5 is mounted above the registration guide 23, and the sheet jam processing is conducted after taking the developing unit 5 off. However, it may be appreciated to adopt a configuration that allows other units than the developing unit 5 to be detachably mounted above the registration guide 23. Further, the foregoing embodiment shows, as a preferable example, the sheet conveying device which can realize the smooth sheet jam processing owing to the pivotable registration guide 23. Accordingly, it should be noted that the tab portion 34, the ribs 35 and the like are not necessarily needed.

The sheet conveying device of the present invention may be applied to various types of copying machines, such as a digital copying machine, a tandem-type color copying machine, an analogue-type monochrome copying machine, and the like, or to image forming apparatuses, such as a facsimile machine, a laser printer, and the like.

As described above, the sheet conveying device according to an embodiment of the present invention includes a registration roller for correcting an oblique conveyance of a sheet by making contact with the sheet, and conveying the sheet in accordance with the timing of the image formation; a conveying roller mounted on an upstream of the registration roller in the sheet conveyance direction for conveying the sheet from the sheet supplying device to the registration roller; and a guide member provided between the registration roller and the conveying roller. The guide member is pivotably supported, and its pivotal axis is in the upstream of the sheet conveyance passage between the registration roller and the conveying roller. The guide member is selectively shiftable over the first position of defining a part of the sheet conveyance passage and the second position of opening the upper portion of the sheet conveyance passage.

In the sheet conveying device, the guide member has the pivotal axis in the upstream of the sheet conveyance passage between the registration roller and the conveying roller, and is selectively shiftable over the first position and the second position. Thus, the turning operation of the guide member can easily be conducted in comparison with the conventional configuration which has the pivotal axis in the downstream of the sheet conveyance passage. Further, a range within which the guide member is rotatable is enlarged so that a large part of the sheet conveyance passage is exposed, to thereby provide the sheet conveying device wherein the jammed sheet can be removed easily with a simple configuration and low cost.

It may be preferable that the tab portion is provided on the conveyance upstream end portion of the guide member, and the tab portion is operable to be pressed to thereby change the guide member from the first position to the second position.

In this case, the tab portion is provided on the conveyance upstream end portion of the guide member, and the guide member is turned from the first position to the second position by pressing the tab portion. Thus, the turning operation of the guide member becomes much easier with the simple configuration.

It may be preferable that the guide member is returnable to the first position from the second position owing to release of the pressing force to the tab portion.

In this case, the guide member returns from the second position to the first position only by releasing the pressing force to the tab portion so that the guide member can be returned to the first position without fail after the completion of the sheet jam processing. Further, the guide member automatically returns to the first position only by releasing the pressing force to the tab portion, to thereby avoid a fear of the deformation or breakage of the guide member or the section due to the erroneous mounting of the section above the guide member while the guide member is in the second position, when the sheet conveying device is mounted in the image forming apparatus.

It may be preferable that the guide member further includes the conveyance passage member which defines the sheet conveyance passage, and the tab portion is integrally formed with the conveyance passage member in the direction substantially orthogonal to the main surface of the conveyance passage member.

In this case, the tab portion is formed in the direction substantially orthogonal to the main surface of the conveyance passage member so that a user can visually recognize the tab portion of the guide member easily. Thus, the sheet jam processing using the tab portion is made to be much easier, and the production cost of the guide member can be reduced since the tab portion is integrally formed with the conveyance passage member.

It may be preferable that the conveyance passage member is pivotably supported by the frame member on which the predetermined section is mountable, and the tab portion is operable to come into contact with the frame member when the guide member reaches the second position.

In this case, when the guide member reaches the second position, the tab portion comes into contact with the frame member. Thus, the user can easily operate the guide member without considering how much the guide member should be turned. Accordingly, the sheet jam processing using the tab portion can be operated much easily. Further, the guide member never turns beyond the second position, to thereby prevent the user from braking the guide member by forcedly turning thereof.

It may be preferable that the tab portion has such a height that the top of the tab portion is below the top of the frame member when the guide member is in the first position.

In this case, an operation capability of the guide member can be ensured while the height of the tab portion is restricted to a necessity minimum. Further, it is not needed to ensure an unnecessary space for providing the tab portion so that the sheet conveying device can be more miniaturized.

The image forming apparatus according to an embodiment of the present invention includes the above mentioned sheet conveying device and the section detachably mounted above the guide member.

In the image forming apparatus, the sheet conveying device is mounted therein, and the section mounted above the guide member is detachable so that the user-friendly image forming apparatus in which the sheet jam processing is easily conducted can be realized.

It may be preferable that the section is the developing unit which forms the toner image on the photoconductive drum.

In this case, the space above the guide member is enough ensured by taking the developing unit off so that the sheet jam processing operation using the guide member can be conducted more easily.

This application is based on patent application No. 2005-250448 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet conveying device comprising:

a pair of registration rollers for correcting an oblique conveyance of a sheet by making contact with the sheet, and conveying the sheet to a position where a photoconductive drum and a transferring roller are arranged in accordance with the timing of an image formation;

a pair of conveying rollers mounted upstream of the registration rollers in a sheet conveyance direction for conveying the sheet along a sheet conveyance passage from a sheet supplying device to the registration rollers;

a conveyance frame defining a bottom surface of the sheet conveyance passage, the conveyance frame having opposite upstream and downstream ends;

a frame member connected to the upstream end of the conveyance frame; and a guide member provided between the registration rollers and the conveying rollers the guide member being pivotably supported, about a pivotal axis in a fixed upstream position relative to the sheet conveyance passage between the registration rollers and the conveying rollers and in a downstream end portion of the frame member, the guide member further having a free end in a downstream position of the sheet conveyance passage between the registration rollers and the conveying rollers, the free end of the guide member being selectively pivotable around the pivotal axis between a first position where at least the free end defines a part of the sheet conveyance passage and a second position where the guide member opens an upper portion of the sheet conveyance passage, the guide member having a tab portion spaced from the pivotal axis and the free end and the tab portion being upstream of the free end of the guide member, and the tab portion being operable to be pressed to thereby change the guide member from the first position to the second position.

2. A sheet conveying device according to claim 1, wherein the guide member is returnable to the first position from the second position owing to release of the pressing force to the tab portion.

3. A sheet conveying device according to claim 1, wherein the guide member further comprises a conveyance passage member which defines the sheet conveyance passage, and the tab portion is integrally formed with the conveyance passage member in a direction substantially orthogonal to a main surface of the conveyance passage member.

4. A sheet conveying device according to claim 3, wherein the conveyance passage member is pivotably supported by the frame member, and the tab portion is operable to come into contact with the frame member when the guide member reaches the second position.

5. A sheet conveying device according to claim 4, wherein the tab portion has such a height that a top of the tab portion is below a top of the frame member when the guide member is in the first position.

6. An image forming apparatus comprising:

a sheet conveying device according to claim 1; and a section detachably mounted above the guide member.

7. An image forming apparatus according to claim 6, wherein the section is a developing unit which forms a toner image on a photoconductive drum.

8. A sheet conveying device comprising:

a pair of sheet conveying rollers defining a sheet conveyance passage therebetween for conveying a sheet along a sheet conveyance direction;

at least one rotationally driven registration roller disposed adjacent the sheet conveyance passage at a position downstream from the pair of conveying rollers for contacting a sheet being conveyed along the sheet conveyance passage and for correcting an oblique conveyance of the sheet; and a conveyance frame defining a bottom surface of the sheet conveyance passage, the conveyance frame having opposite upstream and downstream ends;

a frame member connected to the upstream end of the conveyance frame;

a guide having a pivot support disposed on an upstream side of a portion of said sheet conveyance passage between the pair of conveying rollers and the at least one registration roller and in a fixed position relative to the sheet conveyance passage and in a downstream end portion of the frame member, the guide further having a conveyance passage member projecting from the pivot support into a position downstream of the pivot support between the pair of conveying rollers and the at least one registration roller, the guide having a free end being selectively pivotable about the pivot support between a first position where at least the free end of the conveyance passage member defines a part of the sheet conveyance passage and a second position where the free end of the conveyance passage member is pivotally offset from the sheet conveyance passage to provide access to the sheet conveyance passage, the guide is provided with a tab portion spaced from the pivotal axis and the free end and the tab portion being upstream the free end of the guide, and the tab portion is operable to be pressed to thereby change the guide from the first position to the second position.

9. A sheet conveyance device of claim 8, wherein the portion projects from the pivot support in a direction angularly offset from the conveyance passage member.

10. A sheet conveying device according to claim 9, wherein the frame projects farther from the pivot support of the guide than the tab portion of the guide.

* * * * *